US005223087A

United States Patent [19]

Itani et al.

[11] Patent Number: 5,223,087

[45] Date of Patent: Jun. 29, 1993

[54] CHEMICAL SOLUBILIZING AGENT FOR TIN OR TIN ALLOY

[75] Inventors: Katsutoshi Itani; Akira Hirai, both of Fuji, Japan

[73] Assignee: Tokai Denka Kogyo Kabushiki Kaisha, Tokyo, Japan

[21] Appl. No.: 505,228

[22] Filed: Apr. 5, 1990

[30] Foreign Application Priority Data

Apr. 18, 1989 [JP] Japan ..... 1-96396

[51] Int. Cl.[5] ..... C23F 1/00

[52] U.S. Cl. ..... 156/656; 252/79.4

[58] Field of Search ..... 106/1.05; 156/656; 252/79.2, 79.3, 79.4

[56] References Cited

U.S. PATENT DOCUMENTS 3,597,290 8/1971 Naito et al. ..... 156/666
3,773,577 11/1973 Shibasaki et al. ..... 156/666
3,841,905 10/1974 Dixon, III ..... 252/79.3
4,306,933 12/1981 Da Fonte, Jr. ..... 156/696
4,374,744 2/1983 Kawanabe et al. ..... 252/79.4
4,437,929 3/1984 Wong ..... 252/79.4

FOREIGN PATENT DOCUMENTS 57-164984 9/1982 Japan .

*Primary Examiner*—Mark L. Bell
*Assistant Examiner*—Margaret Einsmann
*Attorney, Agent, or Firm*—Scully, Scott, Murphy and Presser

[57] ABSTRACT

A chemical solubilizing agent for tin or a tin alloy used for electroconductive materials is provided. Said chemical solubilizing agent is an acidic solution containing hydrogen peroxide and an inorganic acid and 0.5–50 g liter of said acidic solution of at least one nitrogen-containing compound selected from the group consisting of heterocyclic compounds not having a double bond in the respective heterocyclic rings, cyclopentylamines and cyclohexylamines.

3 Claims, No Drawings

CHEMICAL SOLUBILIZING AGENT FOR TIN OR TIN ALLOY

BACKGROUND OF THE INVENTION

The present invention relates to a chemical solubilizing agent for tin or tin alloy used for electroconductive materials such as, for example, printed circuit boards being manufactured, electronic and electric devices.

With electric and mechanical development, the components for use in various devices are being complicated and diversified. For example, in some case in a printed circuit board manufacturing process, tin or tin alloy is plated onto a copper foil layer, etching is applied to unnecessary copper portions, then in a later stage the plated portion alone is removed, and the operation shifts to the next step to form a high precision circuit. Further, there are lead frames and copper wires plated with tin or tin alloy or to which tin or tin alloy is bonded mechanically, and it is sometimes required to remove such coating to expose the copper base as in the case of a printed circuit board. For recovering useful metals such as copper from coating scraps in such manufacturing process or from parts which have become unnecessary, the tin or tin alloy is first removed and then copper is recovered through a copper refining process.

As a method for removing tin or tin alloy from the copper surface containing a copper alloy there has been proposed a method which employs a solubilizing agent (i.e. solvent) containing an oxidizing agent and an inorganic or organic acid as main components. As an improvement over such method there is proposed in Japanese Patent Publication Nos. 40291/1977 and 40292/1977 a method which employs hydrogen peroxide or inorganic peracid ion and acid and fluoride or iron ion as a chemical solubilizing agent for tin-containing metals. Further, as a tin or tin alloy releasing solution there is proposed in Japanese Patent Laid-Open No. 164984/1982 the use of an inorganic or organic acid, an oxidizing agent and a heterocyclic compound of =NH or ≡N not containing a sulfur atom. Further proposed are the combination of iron ion, a hydroxycarboxylic acid and the above heterocyclic compound in Japanese Patent Laid-Open No. 58280/1983; the combination of a fluorine-containing complex ion and the above heterocyclic compound in Japanese Patent Laid-Open No. 74281/1984: the use of polyhydric alcohols in Japanese Patent Laid-Open No. 149790/1985; the combination of a fluorine-containing complex iron, silicate iron and the above heterocyclic compound in Japanese Patent Laid-Open No. 20470/1985; and the use of inorganic and organic acids, peroxides, and organic acids which form a complex with tin ion. In the case of such solubilizing agent using an oxidizing agent for tin or tin alloy, even a simple combination of an oxidizing agent and an inorganic or organic acid dissolves tin or tin alloy relatively easily in the initial stage, but with the lapse of time, tin and other metal ions accumulate in the solubilizing agent solution, making the oxidizing agent unstable, or metallic salts, particularly metastannic acid resulting from the oxidation of tin, precipitates in the solution, so that the solubilizing ability of the solution is deteriorated gradually. To prevent this, as in the prior art referred to above, there has been proposed the use of fluoride ion, a fluorine-containing complex, and an organic acid which forms a complex with tin ion. Further, in some electroconductive materials it is required that only a tin or tin alloy coating on the surface of a copper plate or copper wire be dissolved and the copper surface be made difficult to dissolve. To this end it has been proposed to use heterocyclic compounds of =NH or ≡N, e.g. pyrazole, imidazole, triazole derivatives. It has also been proposed to use polyhydric alcohols in order to enhance the luster of the copper surface.

In those solubilizing solutions, however, the dissolution speed of tin or tin alloy is low, that is, the working efficiency is poor; besides, there often remains tin on the copper surface. Moreover, with deterioration of the solubilizing solution and the resulting increase of the tin concentration in the bath, hydrogen peroxide becomes unstable, resulting in that the effect of the solubilizing solution is deteriorated.

It is the object of the present invention to eliminate the above-mentioned drawbacks of the prior art, particularly provide a solubilizing agent capable of dissolving and removing tin or tin alloy from a copper surface rapidly and capable of stabilizing hydrogen peroxide contained therein, as well as a method therefor.

SUMMARY OF THE INVENTION

The present invention resides in a solubilizing agent for chemically dissolving tin or tin alloy from an electroconductive materials having a copper surface to which the tin or tin alloy is fixed or electrodeposited. The solubilizing agent comprises an acidic solution containing hydrogen peroxide and an inorganic acid, and 0.5–50 g/l of one or more nitrogen-containing compounds selected from the group consisting of heterocyclic compounds containing nitrogen and not containing a double bond in the heterocyclic ring, cyclopentylamines and cyclohexylamines.

DETAILED DESCRIPTION OF THE INVENTION

The following are concrete examples of selected nitrogen-containing compounds and endocyclic amines in the present invention.

Heterocyclic compounds: pyrrolidine, 2-pyrrolidone, hydantoin, piperidine, piperazine Cyclopentylamines: cyclopentylamine, 1-methylcyclopentylamine Cyclohexylamines: cyclohexylamine, 1-methylcyclohexylamine Examples of heterocyclic compounds also include those wherein hydrogen bonded to a carbon atom in the ring is substituted by an alkyl group, such as pipecoline which is a derivative of piperidine and 5,5-dimethylhydantoin which is a derivative of hydantoin.

The heterocyclic compounds already proposed are imidazole, triazole and pyrazole, which have heretofore been used widely as copper inhibitors. But as a common point, these compounds have double bonds in their rings as is apparent from the respective structural formulae. As shown in Comparative Examples 2 and 3, these compounds do not accelerate the dissolution of tin of tin alloy although they are superior in suppressing the dissolution of copper.

The present invention is based on the finding that heterocyclic compounds not containing a double bond are effective in improving the solubility of tin or tin alloy and that among the amine compounds generally known as rust preventive agents for copper, endocyclic amines, particularly cyclopentylamines and cyclohexylamines, are effective uniquely.

In the case where a heterocyclic compound or endocyclic amine used in the invention is merely incorporated in the combination of hydrogen peroxide and an acid, the solubilizing solution will be able to exhibit the desired effect in the initial stage just after the preparation of the bath in which the solubilizing solution is not stained yet, but as tin or tin alloy dissolves and accumulates in the bath so the solution is stained, the hydrogen peroxide decomposes remarkably with the result that the dissolution speed of the tin or tin alloy decreases rapidly. To prevent this, it is desirable to use a stabilizer for the acidic hydrogen peroxide. Examples of such stabilizer include glycol ethers such as, for example, ethylene glycol monomethyl ether, ethylene glycol monoethyl ether, ethylene glycol monobutyl ether, diethylene glycol monomethyl ether, diethylene glycol monoethyl ether and diethylene glycol monobutyl ether; fatty acid alcohols such as, for example, ethanol, n-propyl alcohol, n-butyl alcohol, glycol and glycerin; aliphatic ethers such as, for example, ethyl ether and n-propyl ether; aliphatic carboxylic acids such as, for example, propionic acid, aminocarboxylic acid, aminocaproic acid and aminopropionic acid; aliphatic amines and imines such as, for example, n-propylamine, isopropylamine, n-butylamine and n-hexylamine; and acid amide-like compounds such as, for example, propionamide. Even if these compounds are used together with the heterocyclic compounds or endocyclic amines which are employable in the present invention, the respective effects will not be deteriorated and it will be possible to afford a chemical solubilizing solution free of the various problems referred to above and high in productivity.

In the solubilizing agent of the present invention, the concentration of hydrogen peroxide used as a basic component is preferably in the range of 1 to 10 g/l, and preferred examples of inorganic acids which may be used in the invention are sulfuric, nitric, phosphoric, sulfamic and hydrofluoric acids. The concentration of the inorganic acid used in the invention is not specially limited if only it is not less than 10 g/l/ But if it is too low, neutralization will take place due to dissolved metal, so that the deterioration of the solubilizing solution is accelerated, while a too high concentration thereof is not only uneconomical but also causes an increase of the ion concentration in the aqueous solution, thus permitting easier precipitation of dissolved metal. When these points are taken into account, it is desirable to set the concentration of the inorganic acid used in the invention in the range of 50 to 300 g/l. Sulfuric acid is easy to use because it is relatively inexpensive. Phosphoric acid usually chelates with metal ions and stabilizes $H_2O_2$ so its use is desirable. Sulfamic acid and hydrofluoric acid are useful for suppressing the precipitation of dissolved tin or tin alloy. Particularly, for dissolving solder which is a tin alloy, it is effective to use hydrofluorate and fluorate ions.

The dissolution accelerator used in the invention exhibits its effect in an amount not less than 0.5 g/l, but a too small amount thereof will cause an unstable condition when tin ions are accumulated, while a too large amount thereof is uneconomical. A preferred range is 1 to 10 g/l. Further, the concentration of the stabilizer for hydrogen peroxide referred to previously is suitably in the range of 1 to 50 g/l.

In this way there is obtained a solution of a hydrogen peroxide inorganic acid system particularly suitable for dissolving and removing tin or tin alloy. But this solution can dissolve not only tin or tin alloy but also copper as the base material rapidly and therefore, as in the prior art, a copper inhibitor such as, for example, imidazole, pyrazole or triazole may be used as necessary together with the above components of the solution.

The present invention will be described below in terms of working examples thereof. Materials and Evaluation in the working examples:

(1) Materials to be Treated
(a) Size: 0.5 mm×59 mm wide×50 mm long
(b) Material:
  (i) both-side copper-clad laminate (copper 35μ)
  (ii) copper plate
(c) Thickness of tin or tin alloy plating:
  (i) tin plating: 1.5μ
  (ii) tin alloy: 2.0μ
    (tin: lead=60:40)
(2) Evaluation
(a) Dissolution speed (min)
(b) Release of tin or tin alloy (visual)
  ◎ good
  ○ remains slightly (1-3%)
  Δ remains a small amount (4-10%)
  X remains a large amount (above 10%)
(c) Surface of the copper base (visual)
  ◎ good
  ○ somewhat good
  Δ bad
  X disapprobative

EXAMPLE I

A sample of a copper plate plated 1.5μ with tin was immersed at 40° C. in 500 ml of a solubilizing agent comprising an aqueous solution of 5 g/l $H_2O_2$ and 150 g/l $H_2SO_4$ and each of accelerators of Table 1 added 3 g/l into the said aqueous solution.

The dissolution speed of tin was determined and the dissolved state of tin and the surface condition of copper were observed.

TABLE 1

| | Dissolution Accelerator | Sn Dissolution (min) | Sn Release | Cu Surface |
|---|---|---|---|---|
| Comp. Ex. 1 | — | 4'10" | ○ | Δ |
| Comp. Ex. 2 | imidazole | 3'45" | ○ | ◎ |
| Comp. Ex. 3 | triazole | 4'05" | ○ | ◎ |
| Comp. Ex. 4 | glycolic acid | 5' or more | X | X |
| Comp. Ex. 5 | aniline | 5' or more | X | X |
| Ex. 1 | pyrrolidine | 2'07" | ◎ | ◎ |
| Ex. 2 | 2-pyrrolidone | 1'58" | ○ | ○ |
| Ex. 3 | hydantoin | 1'48" | ○ | Δ |
| Ex. 4 | 5,5-dimethyl-hydantoin | 1'55" | ○ | Δ |
| Ex. 5 | piperidine | 2'00" | ◎ | ◎ |
| Ex. 6 | piperazine | 1'59" | | |
| Ex. 7 | cyclopentyl-amine | 2'10" | ○ | Δ |
| Ex. 8 | cyclohexyl-amine | 1'49" | ◎ | ○ |
| Ex. 9 | pipecoline | 2'15" | ◎ | ◎ |

EXAMPLE II

A sample of an epoxy-based copper-clad laminate 35μ in copper thickness plated 2.0μ with the tin alloy was immersed at 40° C. in 500 ml of solubilizing agent comprising an aqueous solution containing 3 g/l $H_2O_2$, 100 g/l ammonium fluoride and 200 g/l borofluoric acid and each of the accelerators of Table 2 added 5 g/l into the said aqueous solution. The dissolution speed of the tin alloy was determined and the dissolving state of the tin alloy and the surface condition of copper were observed.

TABLE 2

| | Dissolution Accelerator | Dissolution of Tin Alloy | Re-lease | Cu Surface |
|---|---|---|---|---|
| Comp. Ex. 6 | — | 3'53" | ○ | X |
| Comp. Ex. 7 | imidazole | 3'55" | ○ | ◎ |
| Comp. Ex. 8 | triazole | 4'02 | ○ | ◎ |
| Ex. 10 | pyrrolidine | 2'51" | ◎ | ◎ |
| Ex. 11 | piperidine | 3'05" | ◎ | ◎ |
| Ex. 12 | piperazine | 2'55" | ○ | Δ |
| Ex. 13 | pipecoline | 2'58" | ◎ | ○ |
| Ex. 14 | cyclohexyl-amine | 3'04" | ○ | ○ |
| Ex. 15 | piperazine, triazole | 3'10" | ○ | ◎ |
| Ex. 16 | pipecoline, imidazole | 3'07" | ◎ | ◎ |

EXAMPLE III

In the step of removing tin from a sample of a copper plate plated 1.5μ with tin, using a solution consisting of 10 g/l $H_2O_2$ and 150 g/l $H_2SO_4$, when tin has dissolved up to 30 g/l, the stability of hydrogen peroxide deteriorates even by an additional supply of $H_2O_2$. To prevent this, the stabilizers shown in Table 3 were added and there was made a comparison. In those (Comparative Examples 9–11) not containing the stabilizers, there occurred a lowering of concentration due to the decomposition of $H_2O_2$ and the dissolving speed of tin decreased. On the other hand, in those containing the stabilizers, the dissolution speed was high and there was recognized no action impeding the effect of the accelerators.

TABLE 3

| | Dissolution Accelerator | | Stabilizer | H2O2 Stability 40° C. × 72 hr | Sn Dissolution | Sn Release |
|---|---|---|---|---|---|---|
| Comp. Ex. 9 | Pyrrolidine | 2 | not used | 43% | 3'11" | ○ |
| Comp. Ex. 10 | piperidine | 2 | not used | 51% | 3'05" | ○ |
| Comp. Ex. 11 | cyclohexylamine | 2 | not used | 48% | 3'01" | ○ |
| Ex. 17 | pyrrolidine | 2 | n-butyl alcohol | 87% | 2'21" | ◎ |
| Ex. 18 | piperidine | 2 | ethylene glycol monobutyl ether | 91% | 2'16" | ◎ |
| Ex. 19 | cyclohexylamine | 2 | propionamide | 85% | 2'08" | ◎ |
| Ex. 20 | cyclohexylamine | 2 | isopropylamine | 91% | 2'15" | ◎ |

What is claimed is:

1. In a method for selectively removing tin or tin alloy adhered to copper or a copper alloy by applying to the tin or tin alloy an effective amount of a chemical solubilizing agent, the improvement wherein said chemical solubilizing agent is an acidic solution containing hydrogen peroxide in a concentration range of from 1 to 10 g per liter, an inorganic acid in a concentration range from about 10 to about 300 g per liter, and 0.5 to 50 g per liter of at least one nitrogen containing compound selected from the group consisting of pyrrolidine, 2-pyrrolidone, hydantoin, piperidine, piperazine, cyclopentylamine, 1-methylcyclopentylamine, cyclohexylamine, 1-methylcyclohexylamine, and a lower alkyl substituted derivative thereof.

2. The method of claim 1, wherein said inorganic acid is sulfuric acid, nitric acid, phosphoric acid, sulfamic acid or hydrogen halide.

3. The method of claim 1 further containing at least one hydrogen peroxide stabilizing agent selected from the group consisting of alcohols, glycol ethers, ethers, aliphatic amines and acid amines.

* * * * *